US008998003B2

(12) United States Patent
McCue et al.

(10) Patent No.: US 8,998,003 B2
(45) Date of Patent: Apr. 7, 2015

(54) BALLASTED CART STORAGE STATION

(75) Inventors: David S. McCue, Manchester, MA (US); Brent Hild, Belmont, MA (US); Teodoro A. Mesa, Lynn, MA (US)

(73) Assignee: McCue Corporation, Peabody, MA (US)

( * ) Notice: Subject to any disclaimer, the term of this patent is extended or adjusted under 35 U.S.C. 154(b) by 55 days.

(21) Appl. No.: 13/355,048

(22) Filed: Jan. 20, 2012

(65) Prior Publication Data

US 2013/0186016 A1 Jul. 25, 2013

(51) Int. Cl.
*A47F 10/04* (2006.01)

(52) U.S. Cl.
CPC ..... *A47F 10/04* (2013.01); *Y10S 248/91* (2013.01)

(58) Field of Classification Search
CPC ..... A47F 10/02; A47F 10/04; A47F 10/045; A47F 7/00; Y10S 248/91
USPC ..... 211/17, 22
See application file for complete search history.

(56) References Cited

U.S. PATENT DOCUMENTS 4,672,779 A 6/1987 Boyd
5,551,578 A * 9/1996 McCue et al. ..... 211/17
6,298,997 B1 * 10/2001 Jarrett et al. ..... 211/17
6,493,997 B2 * 12/2002 Cohen ..... 52/79.9
6,629,388 B2 * 10/2003 Cohen ..... 52/79.9

FOREIGN PATENT DOCUMENTS

EP 0 694 274 1/1996
EP 0694274 1/1996
EP 1 498 053 1/2005
EP 1498053 1/2005

OTHER PUBLICATIONS

International Search Report mailed Apr. 1, 2013, International Application No. PCT/US2012/069113 (4 pages).

* cited by examiner

*Primary Examiner* — Andrew J Triggs
(74) *Attorney, Agent, or Firm* — Occhiuti & Rohlicek LLP

(57) ABSTRACT

A freestanding storage station includes a pair of spaced-apart, generally parallel side members and a roof that is supported by the side members. Each side member includes a cross bar, and at least one saddle-shaped, hollow ballast-receiving member that straddles the cross bar and rests on the ground. When filled with ballast, the ballast-receiving members serve to stabilize the storage station relative to the ground and enable the storage station to resist movement due to environmental winds or collision. The ballast-receiving members include a first ballast-receiving portion and a second ballast-receiving portion, and the ballast member straddles the cross bar such that the first ballast-receiving portion resides on an interior-facing side of the cross bar and the second ballast-receiving portion resides on an exterior-facing side of the cross bar.

21 Claims, 7 Drawing Sheets

BALLASTED CART STORAGE STATION

BACKGROUND OF THE INVENTION

Shopping cart storage stations are provided in the parking lots of many shopping areas, and are used to store and control shopping carts so as to avoid damage to customer's vehicles and to the shopping cans themselves, as well as to prevent clogging of parking spaces and thoroughfares. Some conventional shopping cart storage stations are permanently installed in parking lots. As used herein, the term "permanently installed" refers to being secured to the ground. Examples of being secured to the ground include being secured to the ground using a fastener, or by being partially or fully potted or embedded in the ground. In areas of the country where snow is common, permanently installed cart storage stations may go unplowed, preventing customers from employing them. For this reason, some cart storage stations are intentionally left freestanding to permit easy relocation of the station. As used herein, the term "freestanding" refers to resting on a ground surface without being secured to the ground surface. Since a freestanding cart storage station is not secured to the ground, it is subject to movement by shifting weather patterns or accidental collisions.

SUMMARY

In some aspects, a freestanding storage station is provided that includes a first vertical support, a second vertical support spaced apart from the first vertical support, and a first cross bar extending between the first vertical support and the second vertical support. The storage station includes a third vertical support, a fourth vertical support spaced apart from the third vertical support, and a second cross bar extending between the third vertical support and the fourth vertical support, the second cross bar extending in a direction parallel to the first cross bar. In addition, the storage station includes a third cross bar extending between the second vertical support and the third vertical support, the third cross bar extending in a direction transverse to the first cross bar, and a hollow ballast member including a first ballast-receiving portion and a second ballast-receiving portion, the ballast member straddling the first cross bar such that the first ballast-receiving portion resides on one side of the first cross bar and the second ballast-receiving portion resides on a side of first cross bar that is opposed to the one side.

The freestanding storage station may include one or more of the following features: The first ballast-receiving portion resides on an interior-facing side of the first cross bar and the second ballast-receiving portion resides on an exterior-facing side of first cross bar. The ballast member further includes a third ballast receiving portion, wherein when the ballast member straddles the first cross bar the third ballast receiving portion overlies the first cross bar. The third ballast receiving portion lies between and is continuous with the first ballast-receiving portion and the second ballast-receiving portion. The ballast member comprises a bottom surface that includes an inwardly protruding channel, and the first cross bar is disposed in the channel such that at least a portion of the ballast member overlies the first cross bar. The first ballast-receiving portion and the second ballast-receiving portion each correspond to a hollow interior portion of the ballast member that is configured to receive ballast. The storage station further comprises ballast disposed within the ballast member. The ballast is removable and replaceable. The ballast is selected from the group consisting of liquid, sand, soil and gravel.

The freestanding storage station may include one or more of the following additional features: The ballast member further comprises an opening for adding the ballast to and removing the ballast from said ballast member. The ballast member further comprises a lid that covers the opening and is selectively removable so as to provide access to the opening. The first vertical support, the second vertical support, and the first cross bar define a first station side, the third vertical support, the fourth vertical support, and the second cross bar define a second station side, and the first station side and the second station side are adapted for storing shopping carts therebetween. The freestanding storage station further comprises a station roof supported on, and extending between, the first station side and the second station side. A station front end comprises the first vertical support and the fourth vertical support that is spaced apart from the first vertical support, and the station front end is configured so that shopping carts are unimpeded in movement into the freestanding storage station. The freestanding storage station further comprises a station roof supported on the respective upper ends of at least two of vertical supports selected from the group consisting of the first vertical support, the second vertical support, the third vertical support, and the fourth vertical support. The station roof is supported by the first vertical support and the fourth vertical support so as to extend outward beyond a station side defined by the first vertical support and the fourth vertical support. Each of the first vertical support, the second vertical support, the third vertical support, and the fourth vertical support are free standing.

In some aspects, a storage station is provided that includes a pair of mutually-spaced uprights; a roof extending between and supported on an upper end of the uprights; a cross bar extending between and connecting the uprights, and a hollow, saddle-shaped ballast-receiving member that is supported on and surrounds a portion of the cross bar.

The storage station may include one or more of the following features: The storage station further comprises a second pair of mutually-spaced uprights arranged to support the roof, a second cross bar extending between and connecting the uprights of the second pair of uprights, and a third cross bar extending between and connecting the respective pairs of uprights. The ballast receiving member includes a first ballast-receiving portion and a second ballast-receiving portion, the ballast member straddling the first cross bar such that the first ballast-receiving portion resides on one side of the first cross bar and the second ballast-receiving portion resides on a side of first cross bar that is opposed to the one side.

Advantageously, the shopping cart storage station provides control of in a parking lot or large area, without requiring that the storage station be permanently or even semi-permanently secured to the ground surface. Since the shopping cart storage station is free standing, it can be relocated about the parking area as needed, facilitating maintenance of the parking area, as well as sharing of shopping cart storage stations between different facilities.

The shopping cart storage station includes ballast members that provide stability and prevent the storage station from being moved due to weather or collision. The ballast members are configured to receive various types of ballast. In some aspects, the ballast members can be used in an uncovered configuration, filled with soil, and used as planting boxes to improve the aesthetic appearance of the storage station and the parking area.

The ballast members are formed to resemble a saddle shape, permitting the ballast member to be engaged with the storage station sidewalls without requiring the use of fasteners.

Moreover, when formed of plastic or other similar materials, the ballast members further advantageously minimize or prevent damage to shopping carts as well as to cars within the parking area. For example, damage is minimized or prevented when a car door is opened while the car is adjacent to the storage station.

The shopping cart storage station advantageously provides improved protected storage area for shopping carts which is economical to manufacture, and easy to ship and install.

The shopping cart storage station provides a protected storage area that does not include bars or struts, which in some cases could provide a tripping hazard, extending between opposed sides of the station along the ground surface. In addition, this feature permits shopping carts to enter the storage station in an unimpeded manner.

The shopping cart storage station further advantageously provides a storage station that is non-destructive, highly visible, durable in use, and attractive to the customer.

Modes for carrying out the present invention are explained below by reference to an embodiment of the present invention shown in the attached drawings. The above-mentioned object, other objects, characteristics and advantages of the present invention will become apparent from the detailed description of the embodiment of the invention presented below in conjunction with the attached drawings.

DETAILED DESCRIPTION

Figure 1:
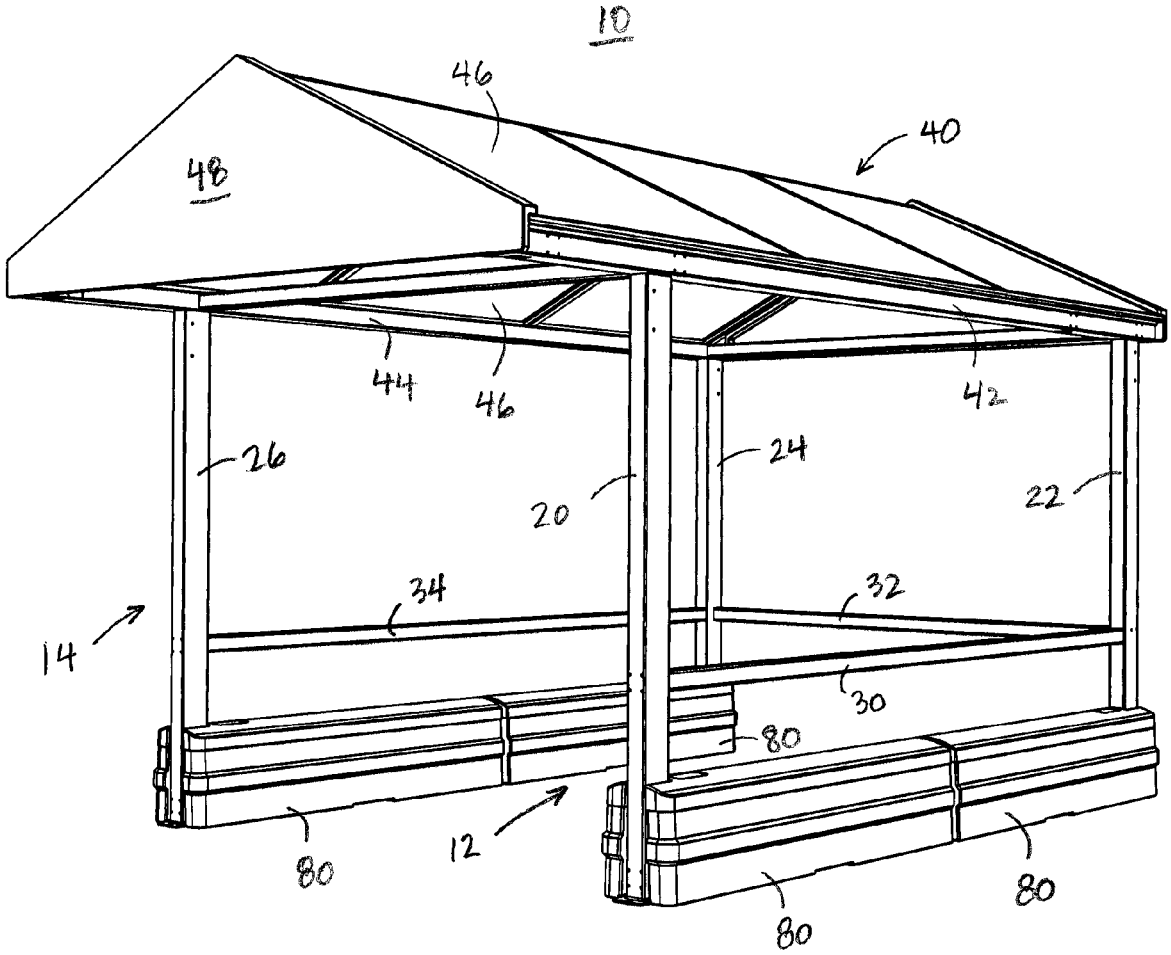
FIG. 1 is a front perspective view of a cart storage station.
Figure 2:
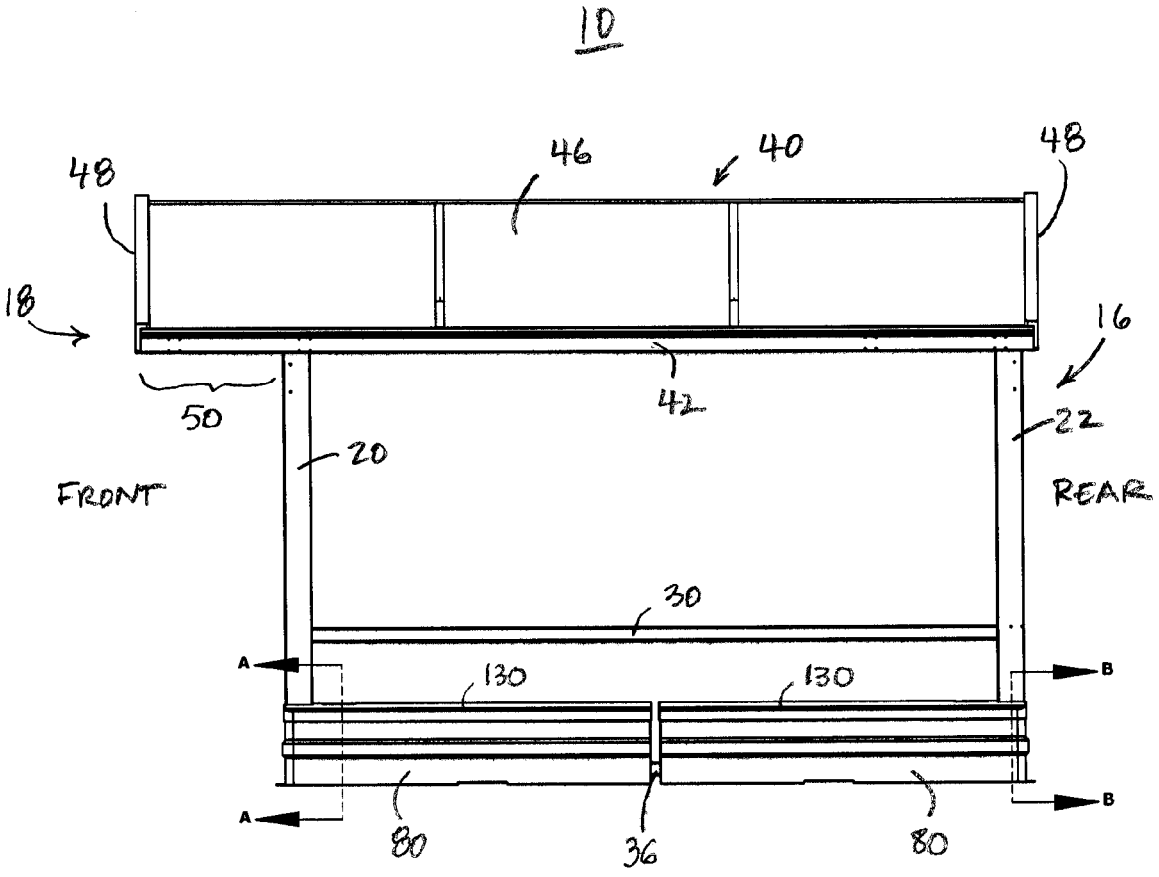
FIG. 2 is a side view of the storage station of FIG. 1

Referring now to FIGS. 1 and 2, a freestanding storage station 10 includes a pair of spaced-apart, generally parallel side members 12, 14, and a roof 40 that is supported by the side members 12, 14. The storage station 10 is stabilized relative to the ground by providing each of the side members 12, 14 with saddle-shaped ballast members 80 that engage the side members 12, 14 and rest on the ground, enabling the storage station 10 to resist movement due to weather or collision, as discussed further below.

The first side member 12 includes a first vertical support 20, and a second vertical support 22 that is spaced apart from the first vertical support 20 along the front-to-rear direction of the storage station 10. The first side member 12 further includes a horizontally-extending rail 30 that connects the first vertical support 20 to the second vertical support 22. Similarly, the second side member 14 includes a third vertical support 24, and a fourth vertical support 26 that is spaced apart from the third vertical support 20 along the front-to-rear direction of the storage station 10. The second side member 14 further includes a horizontally-extending rail 34 that connects the third vertical support 24 to the fourth vertical support 26. The second side member rail 34 extends generally in parallel with the first side member rail 30.

The first side member 12 is connected to the second side member 14 using a connecting rail 32. The connecting rail 32 extends in a direction that is transverse to the front-to-rear direction of the storage station, and thus transverse to the first side member rail 30 and second side member rail 34. In addition to connecting the first side member 12 to the second side member 14, the connecting rail 32 also serves to prevent a shopping cart from exiting from the rear side of the cart storage station 10. Thus, the second vertical support 22, the connecting rail 32 and the third vertical support 24 together define a rear side member 16 of the storage station 10.

The front end 18 of the storage station 10 is defined by the first vertical support 20 and the fourth vertical support 26, which are joined along respective upper ends by the roof 40. In particular, the space between the first vertical support 20 and the fourth vertical support 26 defines an opening in the storage station 10 through which shopping carts pass into and out of the storage station interior space. Since the first vertical support 20 and the fourth vertical support 26 are joined only at the roof 40, the station front end 18 is configured so that shopping carts are unimpeded in movement into the storage station 10.

The vertical supports 20, 22, 24, 26 are freestanding in that they are configured to rest on the ground without being fastened to the ground or embedded in the ground. In the illustrated embodiment, the first, second, third and fourth vertical supports 20, 22, 24, 26 are formed of metal tubes having a square cross-sectional shape.

In the illustrated embodiment, the rails 30, 32, 34 are each positioned at the same distance from the ground. In particular, the rails 30, 32, 34 are positioned between respective upper and lower ends of the vertical supports 20, 22 at a location generally corresponding to a mid-height of a shopping cart. In the illustrated embodiment, the rails 30, 32, 34 are formed of metal tubes having a square cross-sectional shape, and having a cross sectional dimension that is less than the corresponding cross sectional dimension of the vertical supports 22, 24, 26, 28.

In the illustrated embodiment, the storage station includes the roof 40 attached to and supported by the vertical supports 20, 22, 24, 26. The roof 40 includes sloping roof panels 46 supported on longitudinally extending support beams 42, 44. The support beams 42, 44 have a length that is greater than the separation between the first vertical support 20 and the second vertical support 22 (and is greater than the separation between the third vertical support 24 and the fourth vertical support 26), so that an overhanging portion 50 is provided that extends frontward at the front end 18 of the storage station 10. The roof 40 protects customers and stored objects from various environmental factors, including precipitation, wind, and excessive sun. The panels 46 may be clear or opaque, depending upon the amount of sunlight desired within storage station 10. Triangular gables 48 formed at each end of the roof panels 46 may serve as a place to attach signage, posters and other means of communication.

Figure 5:
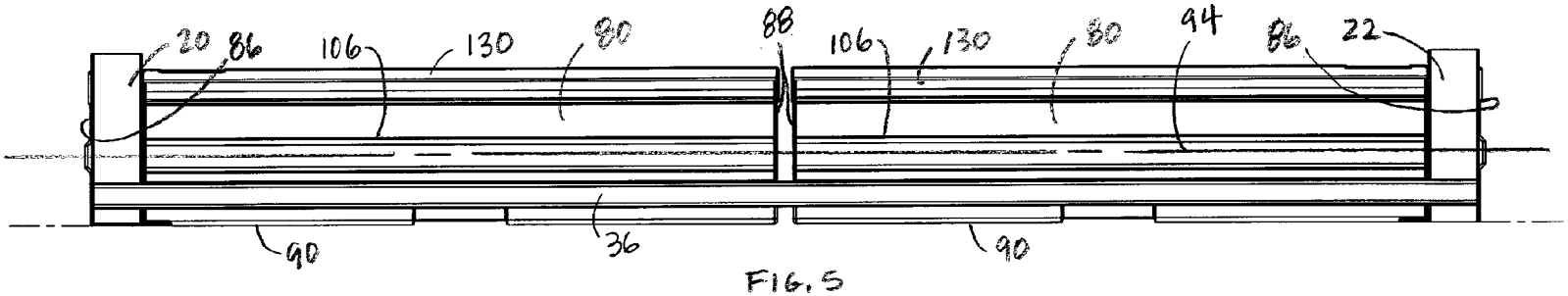
FIG. 5 is a sectional view of the ballast member as seen along line C-C of FIG. 3.

Referring to FIGS. 2 and 5, the first side member 12 further includes a generally horizontally-extending cross bar 36 that extends between the first vertical support 20 and the second vertical support 22. Similarly, the second side member 14 further includes a generally horizontally-extending cross bar (not shown) that extends between the third vertical support 24 and the fourth vertical support 26. The cross bars 36 are disposed adjacent a lower end of the respective vertical supports 20, 22, 24, 26, for example at a location between the respective rail 30 or 34 and the ground. The cross bars 36 are used to support and position saddle-shaped ballast members 80 along the lower ends of each of the first side member 12 and the second side member 14. In the illustrated embodiment, the cross bars 36 are formed of metal tubes having a square cross-sectional shape. In some embodiments, the cross bars are reinforced to provide increased stiffness by including a vertically-extending central rib 36*a* within the hollow interior space of the tube.

Referring to FIGS. 3-6, each ballast member 80 is a hollow structure having an elongated, generally rectangular shape, including a pair of lateral sidewalls 82, 84 that are connected at each end by end sidewalls 86, 88 to form a closed section. The lower end of the ballast member 80 includes a closed bottom 90, and the open upper end of the ballast member 80 is covered by a lid 130. The ballast member sidewalls 82, 84, 86, 88 and bottom 90 together define a receptacle used to receive and store ballast. In the illustrated embodiment, the ballast member 80 has a longitudinal axis 94 that extends between the respective end sidewalls 86, 88 and in parallel to the lateral sidewalls 82, 84.

The ballast member 80, including sidewalls 82, 84, 86, 88, bottom 90 and lid 130 are preferably constructed of a substantially rigid plastic, which may be molded, recycled, composite, or fiber-reinforced plastic. Particularly preferred materials include molded polyethylene and fiberglass. This construction thereby avoids the disadvantages of previous cart corrals in that it is highly visible, does not rust, and is not likely to cause damage to a vehicle or cart upon impact. Moreover, the cart station is highly stable, yet will "give" or flex if inadvertently bumped by a vehicle to absorb a portion of the force of the impact, preventing damage to the cart station itself, to the customer's vehicle, and to the customer's property.

The lateral sidewalls 82, 84 and at least one end sidewall 86 is formed having outwardly protruding bumper 106. The bumper 106 is located at approximately the mid-height of the ballast member sidewall 82, 84, 86. The bumper 106 extends along the length of the respective sidewall and in parallel to the bottom 90. Although the bumper 106 reinforces and adds rigidity to the respective sidewalls 82, 84, 86, its primary purpose is be a point of impact for, and protect the ballast member 80 from, collisions with shopping carts or other objects. In addition, an upper end of each sidewall 82, 84, 86, 88 is formed having a narrow groove 110 dimensioned to receive and retain a corresponding lip 136 formed on the lid 130. The groove 110 and lid lip 136 cooperate to retain the lid 130 on the upper side of the ballast member 80.

The lid 130 includes a cover portion 132 that is outwardly convex to promote shedding of water and debris from the lid 130. In addition, a downwardly extending flange 134 surrounds a periphery of the cover portion 132, and an inwardly-extending lip 136 is formed along the lower edge of the flange 134. The lip 136 is dimensioned to be received within the ballast member groove 110, and serves to retain the lid 130 on the upper side of the ballast member 80.

Figure 4:
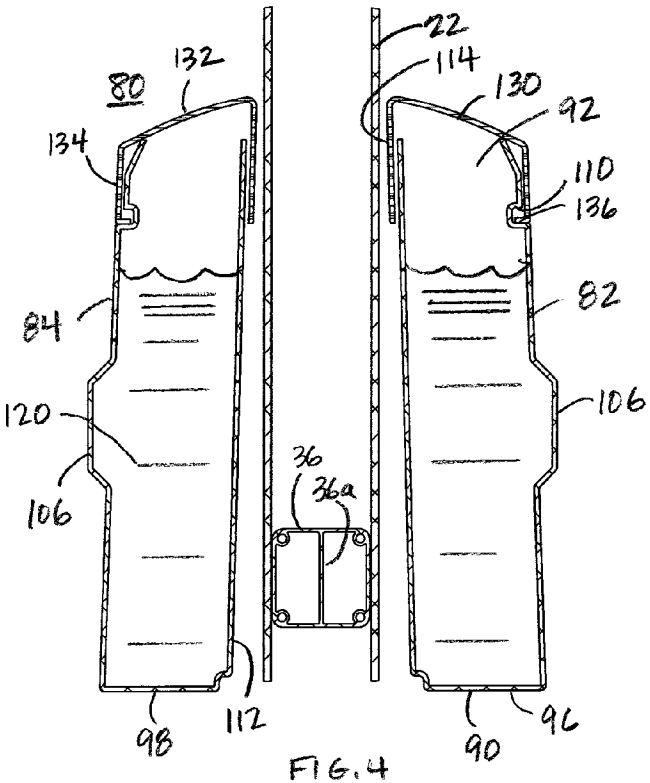
FIG. 4 is a sectional view of the ballast member as seen along line B-B of FIG. 1.
Figure 3:
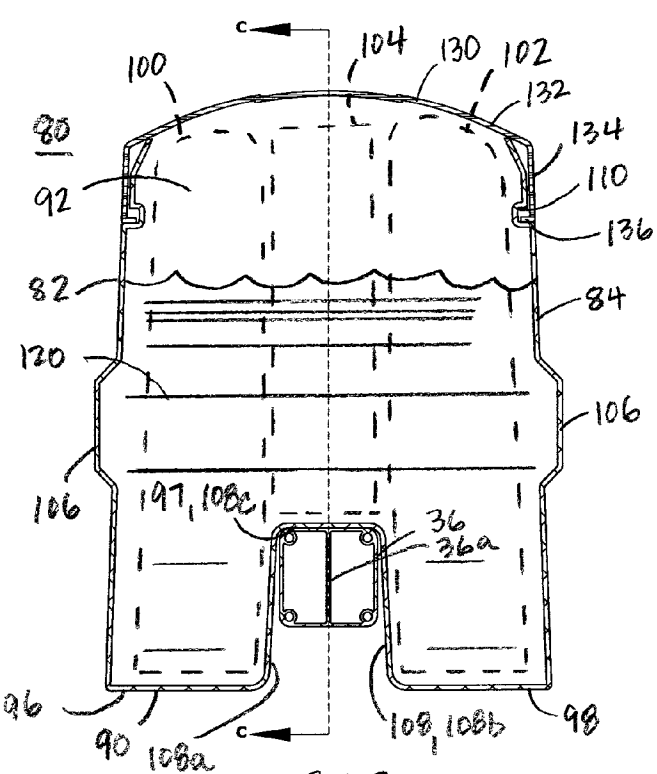
FIG. 3 is a sectional view of the ballast member as seen along line A-A of FIG. 1.

As best seen in FIGS. 3 and 4, the bottom 90 of the ballast member 80 is formed having an inwardly protruding longitudinal channel 108 that extends along the longitudinal axis 94 from one end sidewall 86 to the other end sidewall 88. The longitudinal channel 108 has a generally rectangular cross-sectional shape that is dimensioned to receive a cross bar 36 therein in a fitted manner. The longitudinal channel 108 is further dimensioned so that when the ballast member 80 is disposed within the storage station 10 with the cross bar 36 extending within the longitudinal channel 108, a first portion 96 of the bottom 90 rests on the ground on an interior-facing side of the cross bar 36, and a second portion 98 of the bottom 90 rests on the ground on an exterior-facing side of the cross bar 36. In addition, a third portion 97 of the bottom (corresponding to the innermost portion 108*c* of the channel 108) rests on an upper surface of the cross bar 36. The ballast member 80 resembles the shape of a saddle due to the presence of the longitudinal channel 108, which divides the hollow interior space 92 of the ballast member 80 into regions. For example, a first ballast-receiving portion 100 is defined by the interior-facing lateral sidewall 82, the first portion 96 of the bottom 90, and the interior-facing side 108*a* of the longitudinal channel 108. A second ballast-receiving portion 102 is defined by the exterior-facing lateral sidewall 84, the second portion 98 of the bottom 90, and the exterior-facing side 108*b* of the longitudinal channel 108. A third ballast receiving portion 104 is located within the ballast member in the region above the longitudinal channel 108. The interior space of the ballast member is open and continuous such that the first ballast receiving portion 100 and the second ballast receiving portion 102 are connected via the intermediate third ballast receiving portion.

Figure 6:
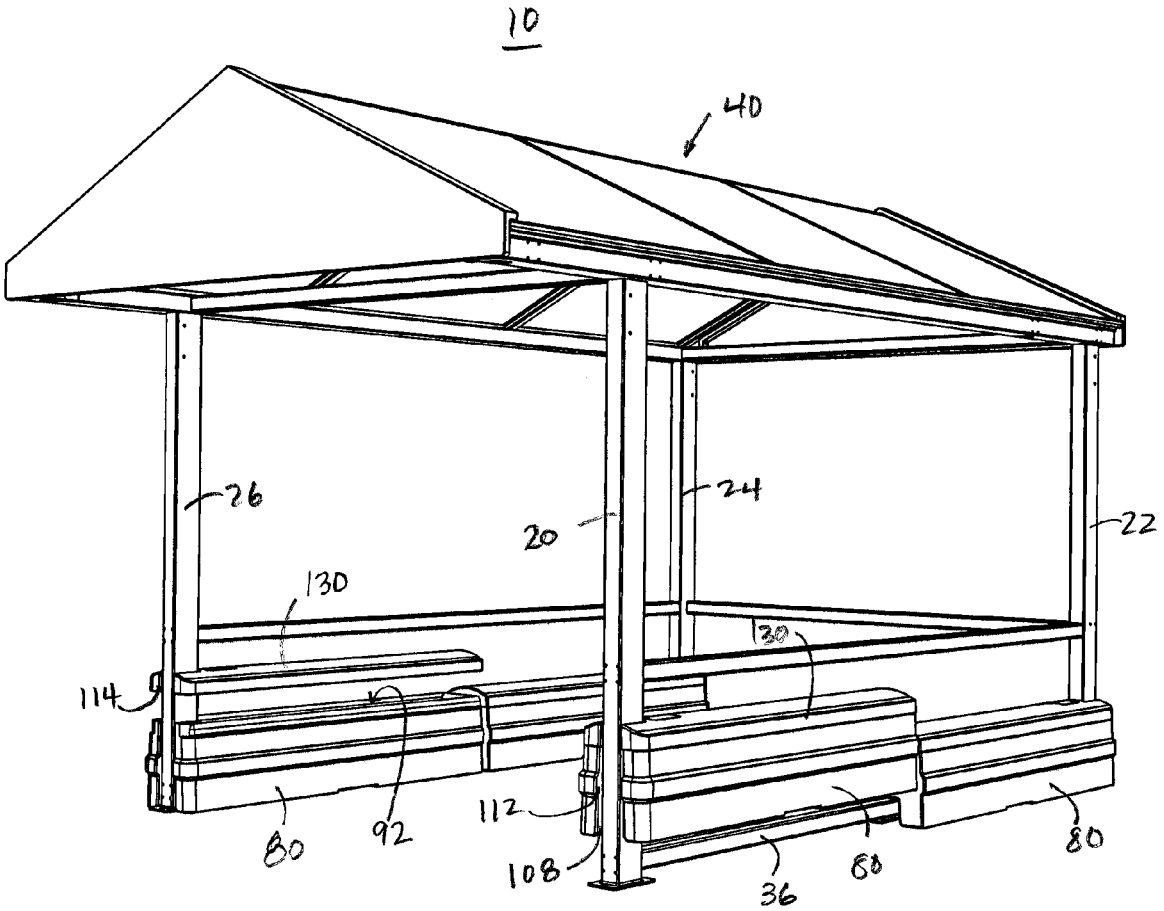
FIG. 6 is a front perspective view of the cart storage station of FIG. 1 illustrating an open ballast member, and a ballast member being assembled on the station sidewall.

As best seen in FIGS. 4 and 6, the outward-facing end sidewall 86 of the ballast member 80 is formed having an inwardly protruding vertical channel 112 that extends along a vertical axis from the open upper end of the ballast member 80 to the bottom 90. The vertical channel 112 has a generally rectangular cross-sectional shape that is dimensioned to receive a respective vertical support member 20, 22, 24, 26 therein in a fitted manner. In addition, the lid 130 is formed having a corresponding lid channel 114 at the end corresponding to the end sidewall 86 of the ballast member 80. The vertical channels 112, 114 connect the ballast member 80 and lid 130 to the vertical supports 20, 22, 24, 26, and prevent the ballast member 80 and lid 80 from twisting in the event of the storage station 10 over turning. In other words; when two ballast members 80 are positioned end-to-end along the cross bar 36 and are connected to the vertical supports 20, 22, 24, 26, the ballast members 80 are prevented from disengaging unless the end sidewall 86 is moved sufficiently to clear the engagement. In addition, by providing two ballast members 80 positioned end-to-end along a cross bar 36, the ballast members lock each other out against the vertical supports 20, 22, 24, 26.

In the illustrated embodiment, the storage station 10 includes four ballast members 80 in that each of the first side member 12 and second side member 14 include two ballast members arranged along the respective cross bar 36. Each of the four ballast members 80 is formed identically, and are formed to be symmetric about a vertical plane extending along the cross bar 36, whereby the ballast members 80 are interchangeable between being used on the first side member 12 and second side member 14, and between a front side location and a rear side location within each side member 12, 14.

In use, the ballast member is filled with a ballast material 120. In the illustrated embodiment, the ballast material 120 is easily removed from ballast member 80 and easily replaced. Ballast materials 120 include, but are not limited to: (1) particulate or crushed solid matter such as soil, gravel, sand, concrete, or small rocks; (2) lump form solid matter such as large rocks, bricks, or cement blocks; or (3) liquid matter such as water. The ballast material 120 provides added weight to storage station 10, thereby stabilizing and securing station 10 in its selected location. The ballast material 120 is added to and/or removed from the ballast member 80 via its open upper end. After the ballast material has been added to the ballast member 80, the lid is secured to the upper end of the ballast member. The lid 130 serves to retain the ballast material within the ballast member 80, prevent precipitation and/or foreign matter from entering the interior space 92 of ballast member 80, and provide a pleasing overall aesthetic appearance to the ballast member 80. A drain (not shown) can be provided at the lower end or bottom 90 of the ballast member 80 to facilitate drainage including removal of liquid ballast.

Figure 7:
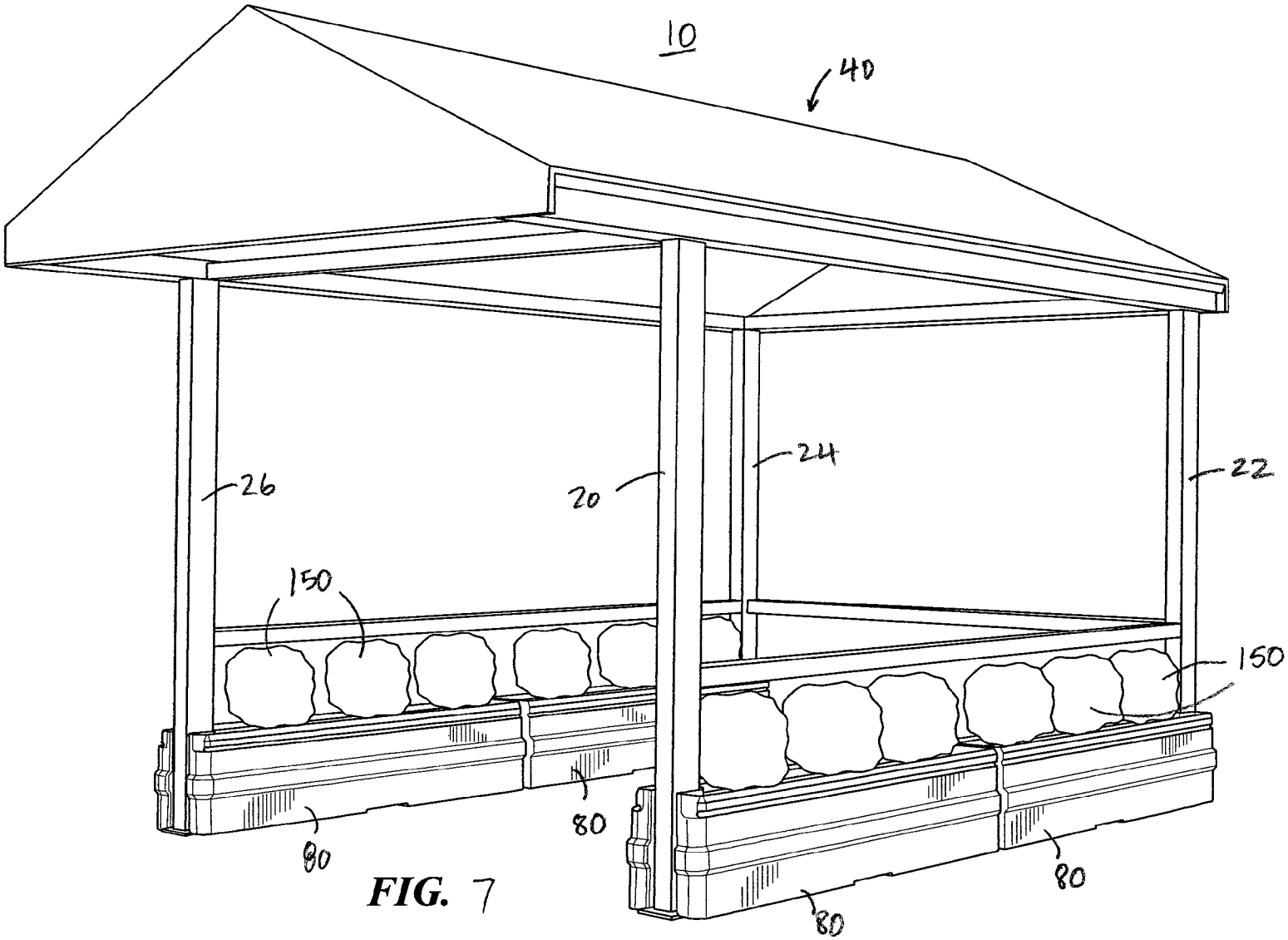
FIG. 7 is a front perspective view of the cart storage station of FIG. 1 illustrating the ballast members being used without lids and including plantings.

Referring to FIG. 7, in some embodiments, the ballast member 80 is employed without the lid 130. For example, the interior space of the ballast member 80 can be at least partially filled with soil, and plants or shrubs 150 can be planted in the ballast member 80, providing an aesthetically pleasing appearance to storage station 10.

Figure 8:
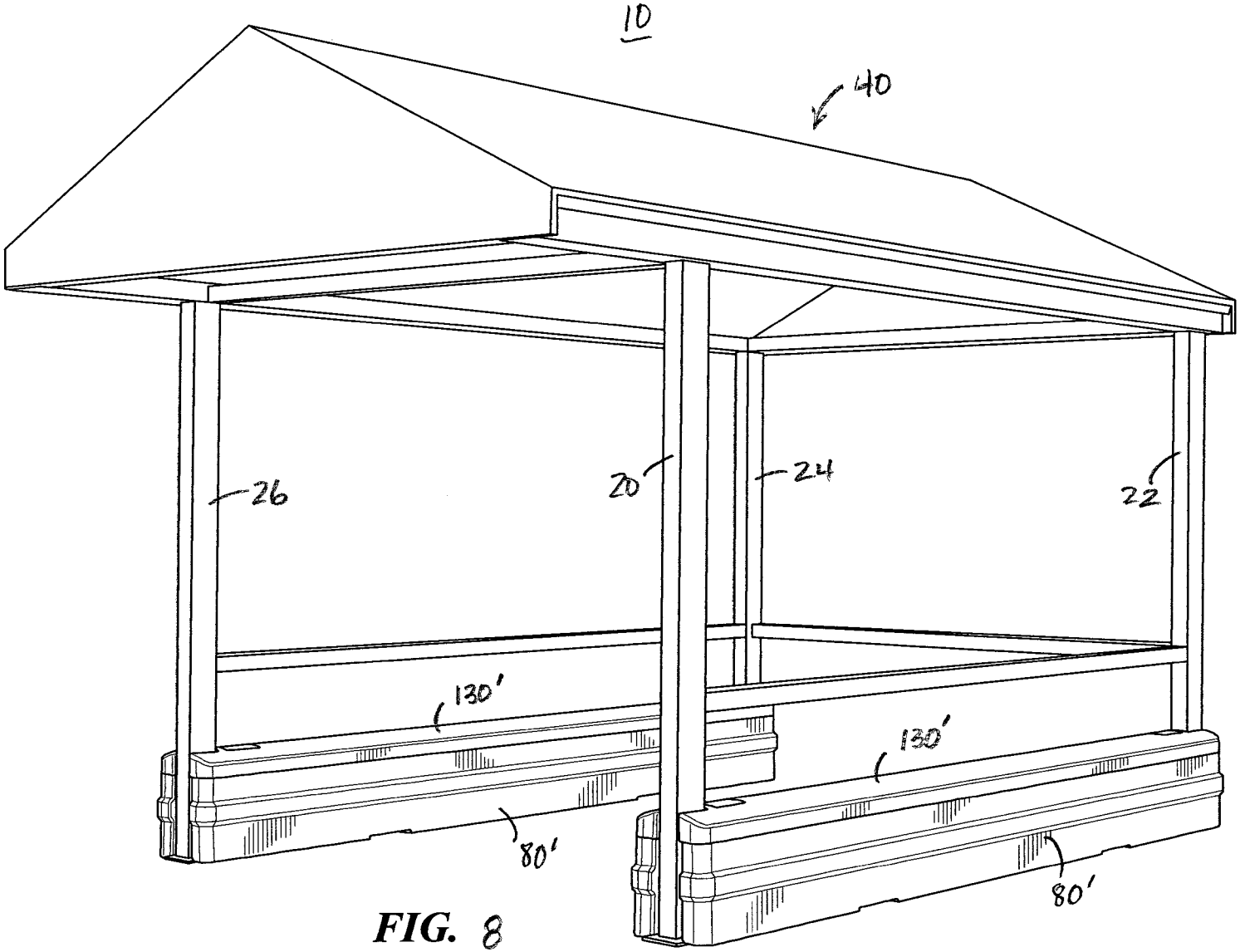
FIG. 8 is a front perspective view of another embodiment of the cart storage station.

Referring to FIG. 8, although the illustrated embodiment discloses that each side member 12, 14 of the storage station 10 includes two ballast members 80, the storage station is not limited to this configuration. For example, a single ballast member 80' may be employed on each side member 12, 14. The single ballast member 80' may have a length that corresponds to the distance between the respective vertical support members 20, 22 as shown in FIG. 8, or alternatively have a length that is shorter than the distance between the respective vertical support members 20, 22. Alternatively, more than two ballast members 80 may be employed on each side member 12, 14.

Figure 9:
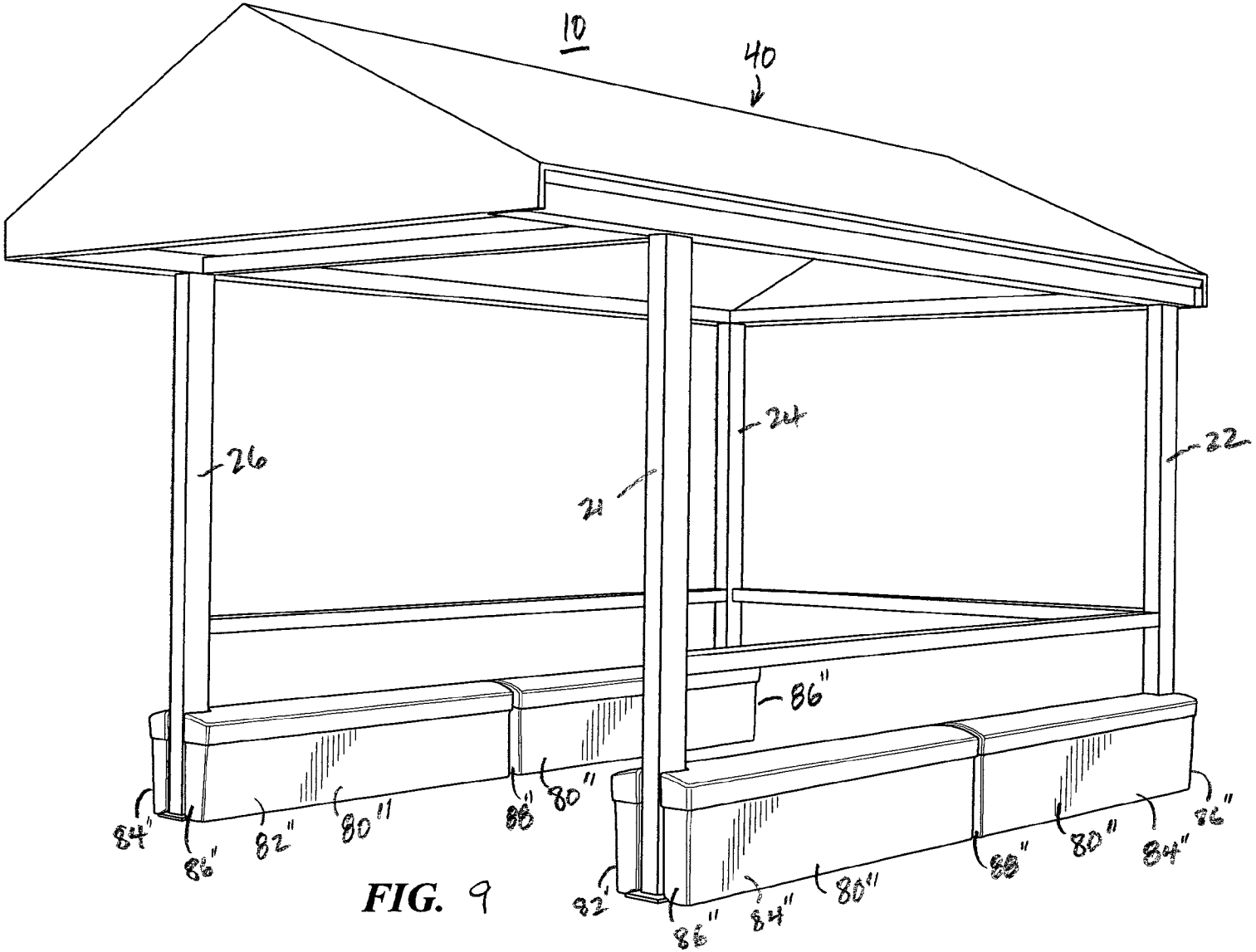
FIG. 9 is a front perspective view of another embodiment of the cart storage station.

Referring to FIG. 9, although the illustrated ballast member 80 has surface features such as the bumper 106 which provide a distinctive appearance, the ballast member 80 may have fewer or greater number of surface features as required by the specific application. As seen in FIG. 9, an alternative ballast member 80" is formed without a bumper 106 and having generally planar sidewalls 82", 84", 86", 88".

Although the bumper 106 is formed by providing the ballast member sidewalls 82, 84, 86 with an outwardly convex portion, but the bumper 160 is not limited to this configuration. For example, the bumper 106 can alternatively be formed as a separate member that is fixed to an external surface of the sidewalls 82, 84, 86. In addition, in some embodiments, reflectors (not shown) can be added to an exterior surface of the ballast member 80.

Although the roof 40 is described as having sloped roof panels 46 including triangular gables 48 formed at each end, the roof 40 is not limited to a peaked configuration, and instead may be formed having a different profile such as rounded or flat.

In the illustrated embodiment, the ballast members 80 are connected to the storage station side members 12, 14 through the engagement of the ballast member longitudinal channel 108 with the side member cross bar 36 and engagement of the ballast member vertical channel 112 with the respective vertical support 20, 22, 24, 26. However, fasteners such as screws or ties may be used to secure the ballast members 80 to the side members 12, 14 if required, for example, to prevent theft.

Although the freestanding storage station 10 is disclosed herein as being used to control and store shopping carts, the free standing storage station 10 can have other applications. For example, the free standing storage station 10 can be used as a shelter from the environment, such as a smoking shelter or bus shelter. In another example, the freestanding storage station 10 can be used to store items other than shopping carts, such as waste bins or bicycles.

A selected illustrative embodiment of the invention is described above in some detail. It should be understood that only structures considered necessary for clarifying the present invention have been described herein. Other conventional structures, and those of ancillary and auxiliary components of the system, are assumed to be known and understood by those skilled in the art. Moreover, while a working example of the present invention has been described above, the present invention is not limited to the working example described above, but various design alterations may be carried out without departing from the present invention as set forth in the claims.

What is claimed is:

1. A freestanding storage station comprising:

a first vertical support, a second vertical support spaced apart from the first vertical support, a first cross bar extending between the first vertical support and the second vertical support, a third vertical support, a fourth vertical support spaced apart from the third vertical support, a second cross bar extending between the third vertical support and the fourth vertical support, the second cross bar extending in a direction parallel to the first cross bar, a third cross bar extending between the second vertical support and the third vertical support, the third cross bar extending in a direction transverse to the first cross bar, and a hollow ballast member extending in a direction along the first cross bar and configured to rest on the first cross bar, the hollow ballast member including a first ballast-receiving portion and a second ballast-receiving portion, and a channel formed in an exterior surface of a wall of the hollow ballast member, the channel formed between the first ballast-receiving portion and the second ballast-receiving portion, the channel extending into the hollow ballast member in a direction substantially along the first vertical support, the channel configured to receive the first cross bar such that at least a portion of the hollow ballast member overlies the first cross bar, wherein the channel extends into the hollow ballast member in a substantially vertical direction.

2. The freestanding storage station of claim 1, wherein the first ballast-receiving portion resides on an interior-facing side of the first cross bar and the second ballast-receiving portion resides on an exterior-facing side of the first cross bar.

3. The freestanding storage station of claim 1, wherein the ballast member further includes a third ballast receiving portion, wherein when the ballast member straddles the first cross bar the third ballast receiving portion overlies the first cross bar.

4. The freestanding storage station of claim 3, wherein the third ballast receiving portion lies between and is continuous with the first ballast-receiving portion and the second ballast-receiving portion.

5. The freestanding storage station of claim 1 wherein a hollow interior portion of the hollow ballast member is configured to receive ballast.

6. The freestanding storage station of claim 1, further comprising ballast disposed within the ballast member.

7. The freestanding storage station of claim 6 wherein the ballast is removable and replaceable.

8. The freestanding storage station of claim 6 wherein the ballast is selected from the group consisting of liquid, sand, soil and gravel.

9. The freestanding storage station of claim 6 wherein the ballast member further comprises an opening for adding the ballast to and removing the ballast from said ballast member.

10. The freestanding storage station of claim 9 wherein the ballast member further comprises a lid that covers the opening and is selectively removable so as to provide access to the opening.

11. The freestanding storage station of claim 9 wherein the opening extends across a width of the ballast member and along a length of the ballast member.

12. The freestanding storage station of claim 1 wherein the first vertical support, the second vertical support, and the first cross bar define a first station side, the third vertical support, the fourth vertical support, and the second cross bar define a second station side, and the first station side and the second station side are adapted for storing shopping carts therebetween.

13. The freestanding storage station of claim 12 further comprising a station roof supported on, and extending between, the first station side and the second station side.

14. The freestanding storage station of claim 1 wherein a station front end comprises the first vertical support and the fourth vertical support that is spaced apart from the first vertical support, and the station front end is configured so that shopping carts are unimpeded in movement into the freestanding storage station.

15. The freestanding storage station of claim 1 further comprising a station roof supported on the respective upper ends of at least two of vertical supports selected from the group consisting of the first vertical support, the second vertical support, the third vertical support, and the fourth vertical support.

16. The freestanding storage station of claim 15, wherein the station roof is supported by the first vertical support and the fourth vertical support so as to extend outward beyond a station side defined by the first vertical support and the fourth vertical support.

17. The freestanding storage station of claim 1, wherein each of the first vertical support, the second vertical support, the third vertical support, and the fourth vertical support are free standing.

18. The storage station of claim 1 wherein the ballast member straddles the first cross bar such that the first ballast-receiving portion resides on one side of the first cross bar and the second ballast-receiving portion resides on a side of the first cross bar that is opposed to the one side.

19. The freestanding storage station of claim 1 wherein the channel is open along a length of the hollow ballast member.

20. The freestanding storage station of claim 1 wherein the channel includes an open end and a closed end opposite the open end, the channel extending into the hollow ballast member in a direction from the open end of the channel toward the closed end of the channel.

21. The freestanding storage station of claim 1 wherein the channel is defined by a recess formed within the exterior surface of the wall.

* * * * *